US005987287A

United States Patent [19]

Huang

[11] Patent Number: 5,987,287

[45] Date of Patent: Nov. 16, 1999

[54] DEVELOPER CYLINDER AND DRIVE GEAR ARRANGEMENT

[75] Inventor: Ya-Li Huang, Taichung, Taiwan

[73] Assignee: General Plastic Industrial Co., Ltd., Taichung County, Taiwan

[21] Appl. No.: 09/240,199

[22] Filed: Jan. 29, 1999

[51] Int. Cl.[6] ..... G03G 15/00

[52] U.S. Cl. ..... 399/265; 399/107; 399/167; 403/359.6; 464/158; 464/182

[58] Field of Search ..... 399/75, 88, 90, 399/167, 107, 265; 403/359.6, 359.2, 383; 464/157, 158, 182, 30

[56] References Cited

U.S. PATENT DOCUMENTS 4,080,079 3/1978 Waara ..... 464/158 X 5,586,833 12/1996 Vossmann et al. ..... 403/359

FOREIGN PATENT DOCUMENTS 10-104997 4/1998 Japan .
10-105022 4/1998 Japan .
10-153941 6/1998 Japan .

*Primary Examiner*—Robert Beatty
*Assistant Examiner*—Sophia S. Chen
*Attorney, Agent, or Firm*—Pro-Techtor International Services

[57] ABSTRACT

A developer cylinder and drive gear arrangement, includes a drive gear having a coupling hole at one end of its gear shaft, and a developer cylinder having a coupling block at its one end coupled to the coupling hole at the gear shaft of the drive gear, wherein the coupling block of the developer cylinder has six peripheral sides and six peripheral angles.

1 Claim, 2 Drawing Sheets

DEVELOPER CYLINDER AND DRIVE GEAR ARRANGEMENT

BACKGROUND OF THE INVENTION

The present invention relates to a developer cylinder and drive gear arrangement used with a developer-replenishing device in a copier, facsimile apparatus, printer or similar electrophotographic image forming apparatus.

FIG. 1 shows a developer cylinder and drive gear arrangement used in the developer-replenishing device of a copier, facsimile apparatus, printer or similar electrophotographic image forming apparatus. This arrangement comprises a drive gear A, and a developer cylinder E driven by the drive gear A. The drive gear A has a gear shaft B at its center. The gear shaft B has a twisted triangular coupling hole C axially disposed on its one end. The developer cylinder E is fixedly mounted with a transmission gear F, and has a twisted, triangular coupling block D axially raised from its one end for coupling to the coupling hole C at the gear shaft B of the drive gear A. Because the developer cylinder E wears quickly with use, it must be replaced when starting to wear. However, the developer cylinder E is not inexpensive. Because the triangular coupling block D is twisted in one direction, its fabrication is complicated, thereby rendering a high manufacturing cost.

SUMMARY OF THE INVENTION

The present invention has been accomplished to provide a developer cylinder for use with a drive gear in a developer-replenishing device, which eliminates the aforesaid problem. It is the main object of the present invention to provide a developer cylinder for use with a drive gear in a developer-replenishing device, which is inexpensive to manufacture. According to the present invention, the coupling block is a hexagonal block having six peripheral sides and six peripheral angles. This design enables the developer cylinder to be quickly injection molded from plastics through a mass production process.

DETAILED DESCRIPTION OF THE PREFERRED EMBODIMENT

Figure 1:
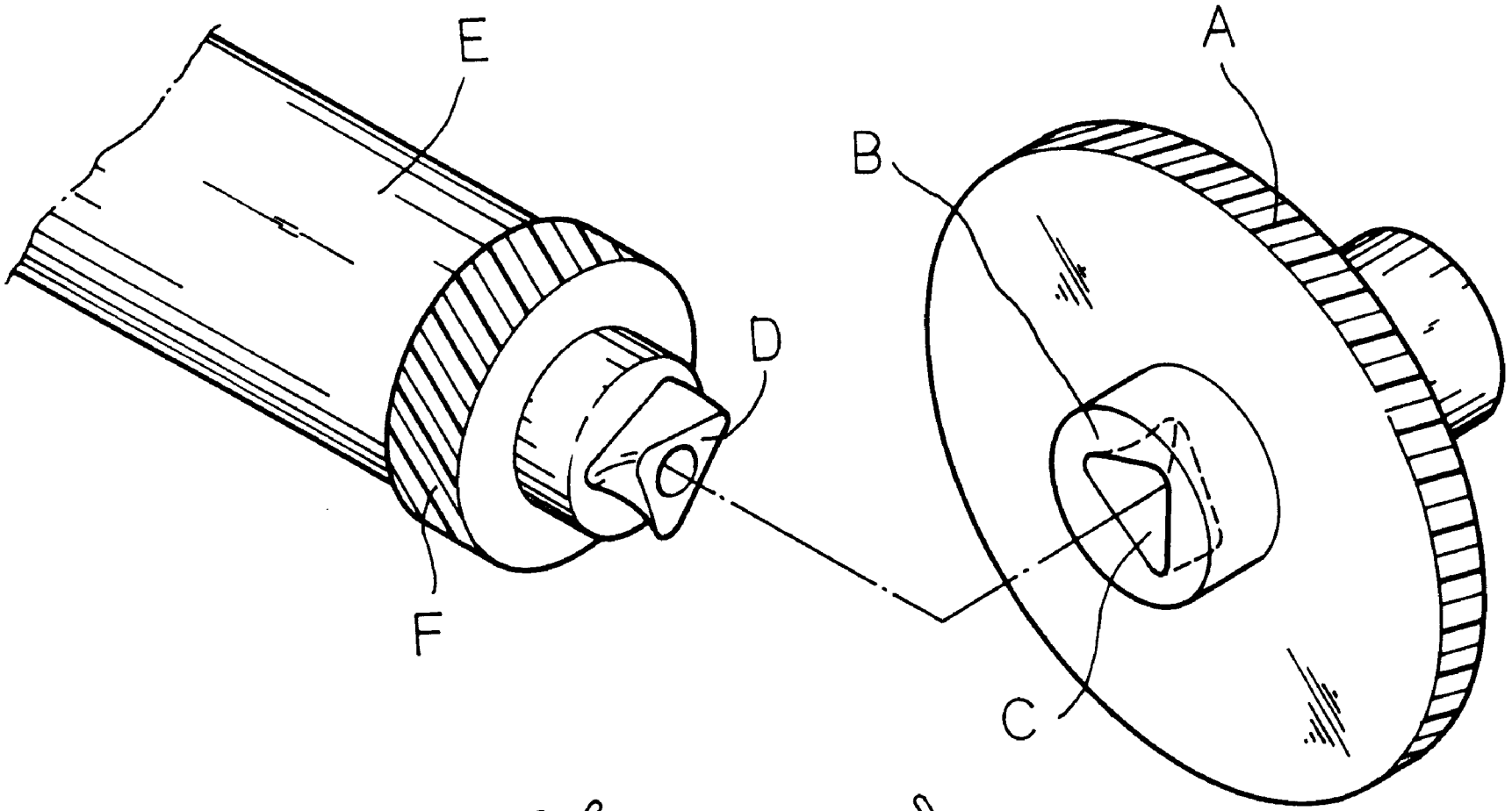
FIG. 1 (PRIOR ART)
FIG. 1 is an exploded view of the prior art.
Figure 2:
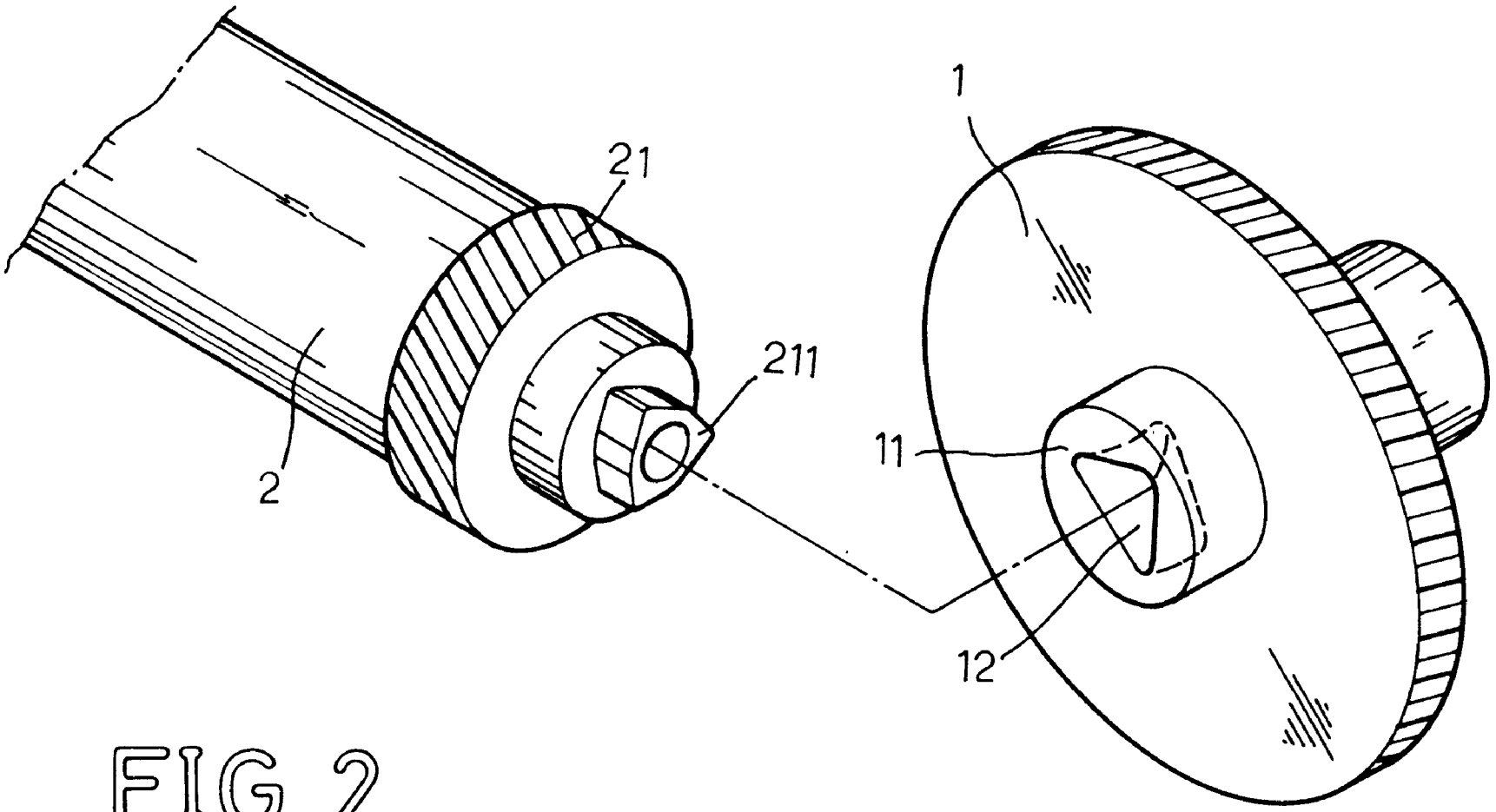
FIG. 2 is an exploded view of the present invention.

Referring to FIG. 2, the present invention comprises a drive gear 1, and a developer cylinder 2. The drive gear 1 comprises a gear shaft 11 at its center. The gear shaft 11 has a twisted, triangular coupling hole 12 axially disposed on its one end. The developer cylinder 2 is fixedly mounted with a transmission gear 21, and has a hollow coupling block 211 axially raised from its one end for coupling to the triangular coupling hole 12 at the gear shaft 11 of the drive gear 1. The hollow coupling block 211 has six peripheral sides and six peripheral angles. After coupling of the hollow coupling block 211 to the coupling hole 12 at the gear shaft 11, the developer cylinder 2 can be positively rotated with the drive gear 1.

What the invention claimed is:

1. A developer cylinder and drive gear arrangement comprising a drive gear, and a developer cylinder driven by said drive gear, said drive gear having a gear shaft, and a twisted triangular coupling hole axially disposed on one end of said gear shaft, said developer cylinder having a coupling block axially raised from one end thereof and coupled to the coupling hole at the gear shaft of said drive gear, wherein the coupling block of said developer cylinder has six peripheral sides and six peripheral angles.

* * * * *